US005816486A

United States Patent [19]

Wein

[11] Patent Number: 5,816,486

[45] Date of Patent: Oct. 6, 1998

[54] CONTAINER WITH SEALING FEATURES

[76] Inventor: Sam Wein, 3355 Genoa Way, Suite 128, Oceanside, Calif. 92056

[21] Appl. No.: 62,875

[22] Filed: Apr. 20, 1998

[51] Int. Cl.[6] ..... B65D 5/74

[52] U.S. Cl. ..... 229/215; 229/125.42

[58] Field of Search ..... 229/215, 217, 229/219, 221, 125, 42

[56] References Cited

U.S. PATENT DOCUMENTS

| | | | |
|---|---|---|---|
| 3,568,910 | 3/1971 | McConnell | 229/125.42 |
| 4,054,240 | 10/1977 | LaPierre | 229/215 |
| 4,194,677 | 3/1980 | Wysocki | 229/215 |
| 4,569,443 | 2/1986 | Roccaforte | 229/215 |
| 4,953,781 | 9/1990 | Bryan | 229/125.42 |
| 5,169,059 | 12/1992 | Desmond et al. | 229/215 |
| 5,215,250 | 6/1993 | Roccaforte | 229/215 |
| 5,372,301 | 12/1994 | Besson | 229/125.42 |
| 5,573,177 | 11/1996 | Hough | 229/215 |

*Primary Examiner*—Gary E. Elkins
*Attorney, Agent, or Firm*—Richard D. Clarke; George T. Parsons

[57] ABSTRACT

A box having a spout with sealing features to provide an improved moisture resistant and sift resistant container. A first sealing feature is a pouring spout of three layers, the first and second layers of which provide a way for opening the spout. The construction of the spout also allows improved sealing because of its snap open and close feature. A second sealing feature uses transverse scoring of numerous panels and flaps with the scoring formed at the juncture between adjacent panels and flaps during manufacture and before assembly. The scoring provides a sealing feature consisting of male and female characteristics with the male scoring mating securely into the channel of the female scoring during assembly. A third sealing feature is the application of hot melt glue in a generally rectangular pattern close to the perimeters of the top panel and the bottom panel. The hot melt glue is also applied in a generally square pattern on one side of each of the dust flaps close to the perimeter of each of these flaps.

12 Claims, 6 Drawing Sheets

CONTAINER WITH SEALING FEATURES

BACKGROUND OF THE INVENTION

1. Field of the Invention

The present invention relates generally to fibrous structures, and more particularly to a box-like container which has several sealing features, thereby providing a more moisture-resistant and more sift-resistant container which is also more efficient to manufacture.

2. Description of the Related Art

The container art field includes many different structures designed to hold objects, fluids and granular or flake-like materials. More specifically, these structures, or containers, are intended to protect the contents from falling or flowing out of the container until required. In addition, these containers, typically in the form of boxes, are frequently meant to keep the contents fresh and relatively dry until required, including such contents as cereals, powders, and grains. Many times, the design of these boxes use fibrous materials, such as cardboard, paper board, or corrugated construction.

Naturally, some means are designed in to enable the user to open the container. Just a few of the previous designs include spouts of various materials and shapes, perforated portions for punching out or through, adhesive covers to spouts or perforated portions, pull-out metal pour spouts, and plastic caps. Although past box designs and attempts at effective sealing have apparently been sufficient to a certain degree, numerous problems have been experienced by the users, even today, after so many years of searching for workable solutions.

Some spout or cap designs are expensive because of the materials or the manufacturing complexity. Some openings, such as perforations, or adhesive covers, do not allow for a well-sealed box. The cover cannot be closed again. Therefore, the contents become stale much quicker, are easily susceptible to moisture ruining the contents, or lumping occurs, preventing the contents from flowing out of the box at all. The user sometimes resorts to tearing the box apart just to adequately remove the contents.

Therefore, it is clear that a need exists for an improved box design which is easily opened, equally easy to seal to protect the contents, and is also economical to manufacture.

In a successful attempt to overcome some of these difficulties mentioned above, the present inventor has been granted U.S. patents. Wein U.S. Pat. No. 4,953,707 discloses a box with an improved pouring arrangement. Although this arrangement provides for an improved sealing capability, the present inventor has designed additional unique improvements for sealing. Wein U.S. Pat. No. 5,044,503 discloses a box gluing arrangement for improved closures. Although this arrangement also provides for an improved sealing capability, the present inventor has designed additional unique gluing arrangements.

SUMMARY OF THE INVENTION

The above-mentioned difficulties and problems of the prior art are overcome by the present invention. Briefly stated, the present invention provides novel improvements to a box for sealing the contents against moisture, and unwanted leakage of the contents. In summary, the present invention represents a box having several unique sealing features. No longer will the user have to discard purchases because of inedible or unusable contents. No longer will the manufacturer of the boxes have to manage so many parts and assemblies. And no longer will the user be as frustrated with difficult to open and difficult to seal boxes.

More specifically, the present invention includes an improved multi-layer fibrous material or cardboard spout which snaps open and snaps closed providing a relatively tight seal which reduces moisture and prevents contents from leaking. In addition, this invention includes an improved box pattern for more efficient manufacture and better sealing by using male and female scoring on opposite sides of the pattern. Finally, this invention includes a unique gluing improvement for covers and dust flaps that more effectively seals the box after assembly. These unique improvements also mean that the frequent use of a paper-like or waxed paper type inner bag can be eliminated from the manufacturing or assembly process, thereby significantly reducing costs. At the same time, the great user frustration of opening and resealing such an inner bag is also eliminated.

Even more specifically, the box has two side panels, a top panel, a bottom panel, and two end panels. The spout is formed from three layers, or plies, of fibrous material, cardboard or similar appropriate material. The first, and outer layer, has a flap pivotal about one edge of the layer. The first layer overlays part of the second layer. The second layer is also pivotal about one edge of this layer. Means are also provided in this second layer for lifting the flap. Just one novel feature of the second layer, and therefore, the spout, is the design of the second layer. Two wing flaps at opposite ends of this second layer include scored junctures allowing the wing flaps to bend during opening or closing of the spout. A second means for bending the wing flaps are provided through perforations located near the opposite ends of the wing flaps. The third layer has an opening for pouring contents of the box. The opening is covered by the second layer when the spout is closed.

To achieve an open position, the first flap in the first layer is pivoted about one edge, then the second flap is pivoted about one edge of this second flap. As the second flap is pivoted, the wing flaps are bent at the previously mentioned junctures and virtually simultaneously at the perforations. This pivoting of the first and second layers reveals the opening in the third layer to permit dispensing of the box contents. Moreover, the spout when opened locks in the open position, because of its novel construction, and will not inadvertently close when a user is actively pouring contents from the box. Likewise, when closed, this novel spout design locks closed and will not inadvertently open when the open position is not desired. In this way, the novel spout facilitates staying locked open for certain pouring and locks in the closed position so container contents will not spill out when the container is tipped or topples over.

Furthermore, the novel spout design enables spouts of varying size be constructed. Spouts with an outer finger notch for opening by a user can be made in large and very large sizes to accommodate dispensing of larger particles stored within the container, such as corn flakes or other large particle contents. Even when very much enlarged, the spout still locks in the open and closed positions to facilitate certain pouring and eliminating unwanted content leaking or spilling.

The second sealing feature is male and female scoring formed in the flat pattern of the box during manufacture and before gluing, folding and final assembly. Transverse female scores and transverse male scores are formed at the juncture between adjacent panels of the box. The result of this complimentary scoring during the box assembly operation is that each transverse male scoring mates securely into a channel of each transverse female scoring. Therefore, easier, more rapid, and more efficient manufacture results, costs are significantly reduced, and a better container seal is provided following assembly with reverse scoring.

A third sealing feature is applying hot melt glue in either a generally rectangular pattern or a generally square pattern, depending on the particular panel or dust flap of the box. These patterns are applied during box manufacture in close proximity to the perimeter of applicable dust flaps and panels. Portions of the top panel, the bottom panel and the dust flaps have hot melt glue applied. Just one advantage of this glue pattern is tighter sealing, based in part on added glue, plus the close proximity of the glue pattern to the various perimeters.

These, and other features and advantages of the present invention are set forth more completely in the accompanying drawings and the following description.

BRIEF DESCRIPTION OF THE DRAWINGS

Details of the invention, and of the preferred embodiment thereof, will be further understood upon reference to the drawings, wherein closely related elements have the same number but different alphabetical suffixes, and further wherein.

DETAILED DESCRIPTION OF THE PREFERRED EMBODIMENT

Figure 1:
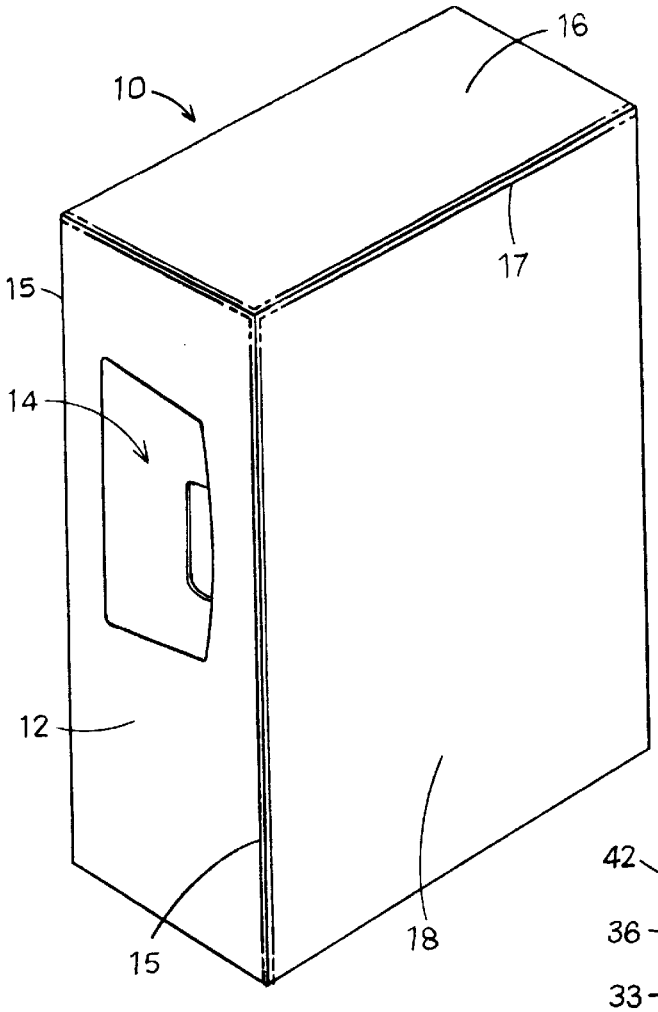
FIG. 1 is a perspective representation showing the fully assembled container of the present invention.

Referring initially to FIG. 1, a perspective representation of a box 10 is shown illustrating the fully assembled container of the present invention. The box 10 is manufactured from a single piece of fibrous structure, such as cardboard, although other materials may be used. When assembled, the box 10 has two end panels, two side panels, and a top and bottom panel, a total of six sides. A typical end panel 12 is shown with a preferred embodiment of a pouring spout 14 incorporated. The spout 14 is preferably located inwardly from an end panel perimeter 15 of the end panel 12. The exact location of the spout 14 is variable depending on the particular pouring application of the contents of the box 10. Adjacent to and foldably connected to the end panel 12 is a top panel 16 and a typical side panel 18. The side panel 18 is connected to the end panel 12 at the perimeter 15. The top panel 16 is connected to the side panel 18 at a side perimeter 17. Not shown in FIG. 1 are the opposite panels, that is, a second end panel, a second side panel and a bottom panel. The bottom panel is opposite to the top panel 16 at the other end of the box 10. Therefore, it is clear by extension of the previous discussion, that each end panel 12 is adjacent to and foldably connected to two side panels 18, the top panel 16 and the bottom panel (not shown). Another way of describing the construction of the box 10 is to state that before assembly, the entire box 10, when laid flat, is one continuous piece of material.

Figure 2:
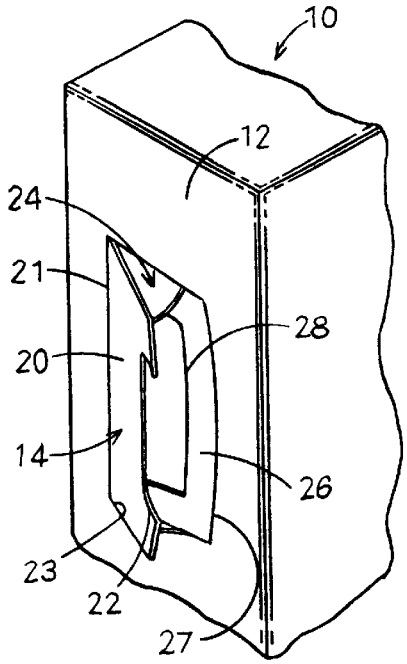
FIG. 2 is a fragmentary perspective representation of the container illustrating the open spout constructed in accordance with the concepts of the present invention.

Referring next to FIG. 2, a fragmentary perspective representation of the box 10 is shown illustrating the spout 14 in the open position for pouring contents of the box 10. The spout 14 has a first outer layer 20 having a first notch 22 cut out of a first layer perimeter 23 of the first outer layer 20. The first notch 22 is of sufficient size and shape to allow someone holding the box with one hand to insert one of his or her fingers from the other hand into the first notch 22. The first layer 20 is pivotal about a first layer edge 21. The edge 21 is on the opposite side of the first layer 20 from the first notch 22. The first layer 20 is overlying and secured to a second layer 24 inwardly of the first layer 20. This first layer 20 is also secured to the second layer 24 between the edge 21 of the first layer and the first notch 22 in the first layer 20. Next, the second layer 24 has a third layer 26 secured to it, and located inwardly from the second layer 24. The means of securing will be discussed when describing FIG. 11. The third layer 26 has a cut 28 forming a three-sided opening in one portion of a third layer perimeter 27. The third layer 26 is covered by the second layer 24.

Figure 3:
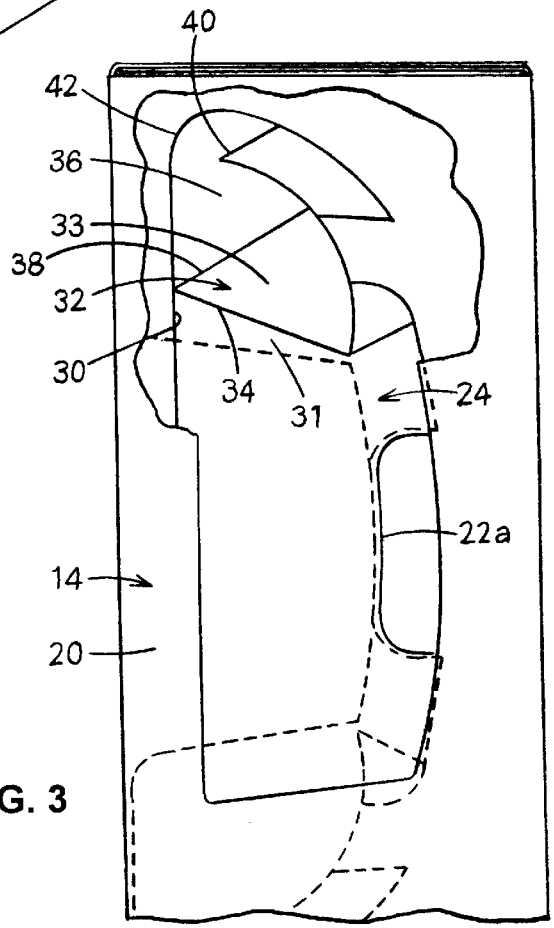
FIG. 3 is an enlarged broken away perspective representation of a portion of the second layer of the spout.

Now referring to FIG. 3, an enlarged broken away perspective representation is shown of a portion of the second layer 24 of the spout 14. The remainder of the second layer 24 is shown in phantom. The second layer 24 is pivotal about a second layer edge 30. This edge 30 in the second layer 24 is underneath the edge 21 in the first layer 20. The second layer can be described as having three parts, yet integral with each other; two wing flaps and a center portion 31. In the center portion 31 is a second notch 22*a* at a location spaced from the one edge 30 of the second layer 24. The second notch 22*a* is underneath the first notch 22 in the first layer 20. The second notch 22*a* is virtually identical in size and shape to the first notch 22. As previously described, the first layer 20 is overlying and secured to the second layer 24 inwardly of the first layer 20.

As shown in FIG. 3, one typical wing flap 32 is illustrated. Each wing flap 32 also has two portions, a first portion 33 and a second portion 36. Both portions 33, 36 are roughly shaped like a sector from a circle. Each wing flap 32 includes means for permitting bending of each wing flap 32 at scored junctures in the second layer 24. Each wing flap 32 is located at an opposite end 42 of the second layer 24. Furthermore, each wing flap 32 includes additional means for permitting bending of each wing flap 32 at perforations in locations proximately and equally spaced from each opposite end 42. More specifically, the first portion 33 of the wing flap 32 is bendable at a scoring 34. The second portion 36 is bendable at a perforation 38 between the first portion 33 and the second portion 36. The second portion 36 has a hook-like portion 40 formed in it at one of the opposite ends 42 in the second layer 24.

Therefore, to achieve an open position of the spout 14, the first outer layer 20 is pivoted about the first layer edge 21, simultaneously with the second layer 24 being caused to pivot about the second layer edge 30 because the first layer 20 and the second layer 24 are secured to each other. More specifically, someone holding the box 10 with one hand inserts one of his or her fingers from the other hand into the first notch 22 and the second notch 22*a*, both notches 22 and 22*a* being secured to each other. Then the user lifts the second layer 24 with his finger in the second notch 22*a* to snap open the spout 14 to its open position for pouring the contents of the box 10.

Even more specifically in describing the opening operation of the spout 14, is the key operation of each wing flap 32. As the second layer 24 is lifted, each wing flap 32 is bent virtually simultaneously, and in one continuous motion, at the scoring 34 and the perforation 38. Also, as the second layer 24 is lifted, the third notch 28, forming an opening in the third layer 26 is uncovered to permit dispensing of the contents of the box 10 through this opening in the third layer 26. In the final open position of the spout 14, the first portion 33, of each wing flap 32, moves from a horizontal position in the second layer 24 to an almost vertical position, approximately at a right angle to the third layer 26. The first portion 33 is now in contact with the third layer 26 at the scoring 34 of the first portion 33, effectively locking the spout 14 into the open position. Just one advantage of this novel spout 14 is the quick and easy opening and snapping into place, thereby allowing immediate pouring of the contents of the box 10.

Figure 4:
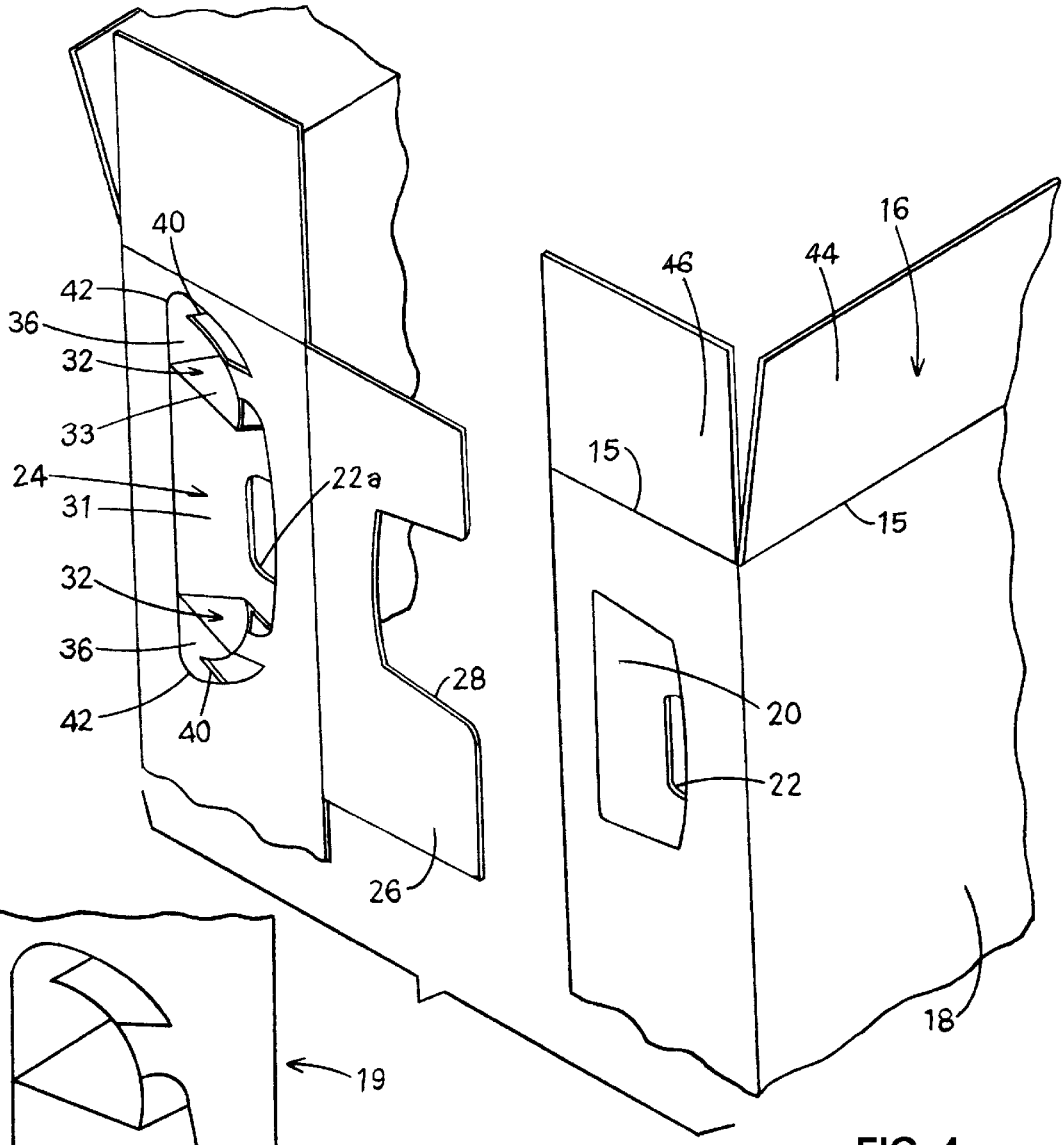
FIG. 4 is an exploded fragmentary perspective representation of the present invention illustrating the three layers of the spout.

Referring now to FIG. 4, an exploded fragmentary perspective representation more clearly shows the three layers 20, 24, and 26 of the spout 14. The first and preferred configuration, as shown in FIG. 4, illustrates the third layer 26 in a position to be folded up and underneath the second layer 24 during assembly. Also more clearly shown in FIG. 4 is the detail partially shown in phantom in FIG. 3. At the opposite end 42 of the second layer 24 is seen the wing flap 32. At the other opposite end 42 is seen an identical wing flap 32.

Additionally in FIG. 4, the top panel 16 is shown with an outer cover flap 44 as part of the top layer 16. The top panel 16 actually has two parts, the outer cover flap 44 and an inner cover flap (not shown). The top panel 16 is foldably connected to the side panel 18 at the side panel perimeter 17 as previously described when discussing FIG. 1. Now also seen in FIG. 4 for the first time is a typical dust flap 46. The dust flap 46 is foldably connected to the end panel 12 at the end panel perimeter 15. A total of four dust flaps are incorporated in the box 10. During assembly, each dust flap 46 folds underneath the inner cover flap of the top panel 16. Subsequently, during assembly, the outer cover flap 44 folds over the inner cover flap.

Figure 5:
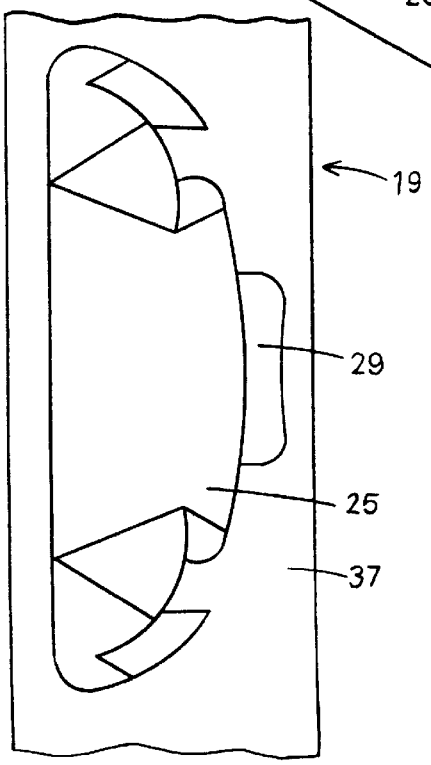
FIG. 5 is an enlarged fragmentary schematic representation illustrating another spout design, with an outer finger tab, according to the present invention.

Referring now to FIG. 5, an enlarged fragmentary schematic representation illustrating another box 19 having a second spout design embodiment, namely, spout 25, featuring an outer finger notch 29, according to the present invention.

Figure 6:
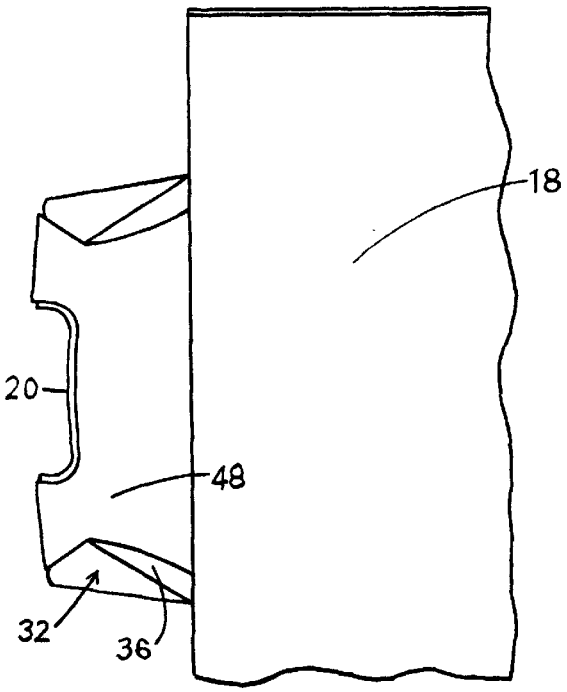
FIG. 6 is a fragmentary schematic elevation representation of the spout, illustrating the open position of the spout, according to the present invention.

Next, referring to FIG. 6, a fragmentary schematic elevation representation of the spout is shown, illustrating the open position of the spout. Shown for the first time is an underside surface 48 of the second layer 24.

Figure 7:
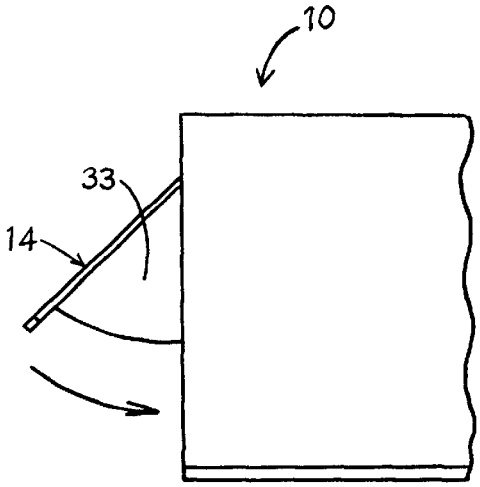
FIG. 7 is a fragmentary schematic end view representation of the spout, illustrating the open position of the spout, according to the present invention.

Referring to FIG. 7, a fragmentary schematic end view is shown of the spout 14 in the open position. In addition, the closing motion is indicated by arrow, whereby a user pushes on the spout 14 until it is closed and effectively locked into the box 10. Another clear advantage of this unique spout 14 is the snapping closed action. Once closed, the contents are protected from moisture and more sift-resistant. And because of the three layer construction, the spout 14 is strong yet inexpensive to make. In addition, the spout 14 strength allows repeated openings and closings without damaging the spout 14 or compromising its integrity.

Figure 8:
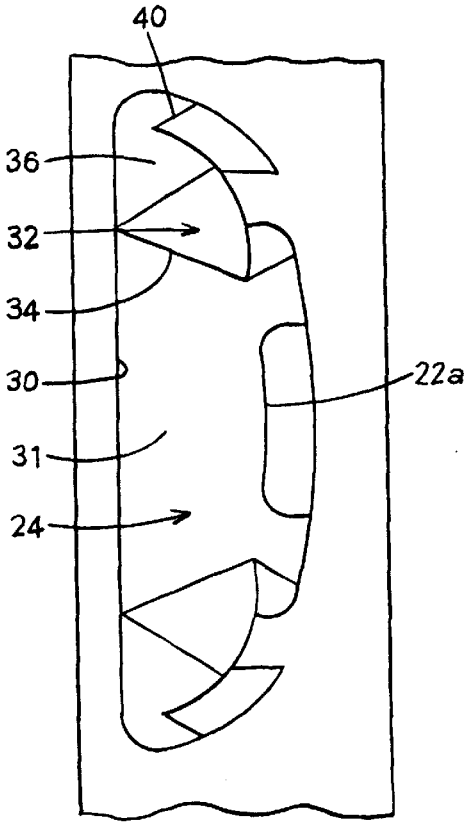
FIG. 8 is an enlarged fragmentary schematic elevation representation of the second layer of the spout, according to the present invention.

Referring now to FIG. 8, an enlarged fragmentary schematic elevation representation is shown of the second layer 24 of the spout 14.

Figure 9:
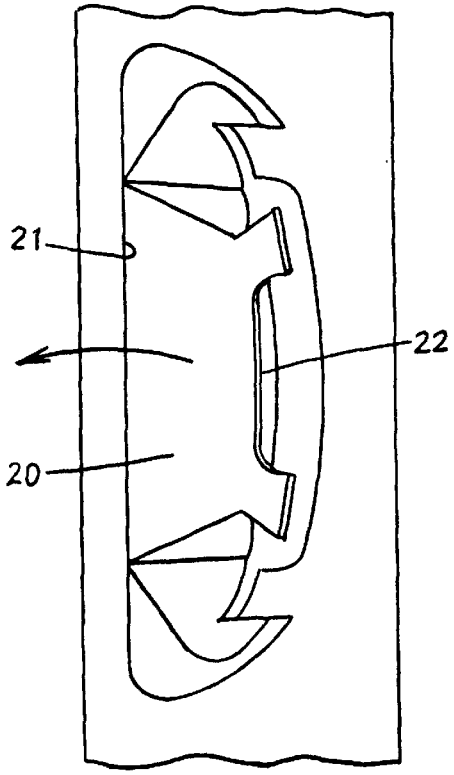
FIG. 9 is an enlarged fragmentary schematic elevation representation of the spout illustrating the lifting motion as the spout is opened, according to the present invention.

Next referring to FIG. 9, an enlarged fragmentary schematic elevation representation is shown of the spout 14 clearly illustrating the opening motion of the spout 14. The arrow shows the lifting of the first layer 20 and the second layer 24, since they are secured to each other.

Figure 10:
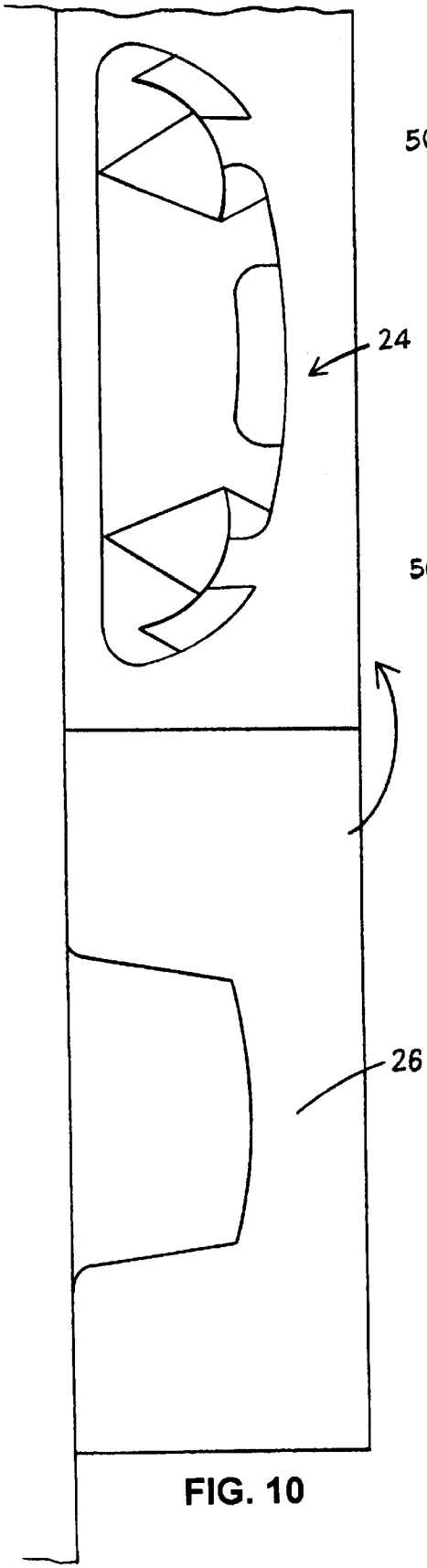
FIG. 10 is an enlarged fragmentary schematic representation of the complete second and third layers of the spout, according to the present invention.

Referring to FIG. 10, an enlarged fragmentary schematic representation is shown of the complete second layer 24 and the third layer 26 of the spout 14. This FIG. 10 also shows an alternate configuration of the third layer 26. In this configuration, the third layer 26 is manufactured alongside the second layer 24, such that during the assembly operation, the third layer 26 is folded across the second layer and secured with glue. The first and preferred configuration, as shown in FIG. 4, illustrates the third layer 26 in a position to be folded up and underneath the second layer 24 during assembly.

Figure 11:
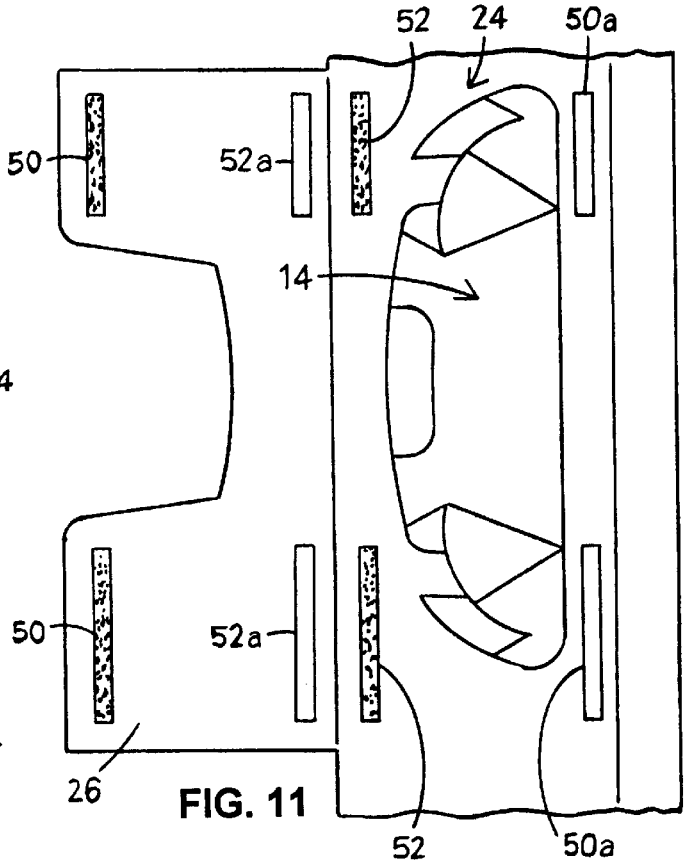
FIG. 11 is a fragmentary schematic representation of the second and third layers of the spout illustrating a pattern of hot melt glue used to secure the second and third layers together, according to the present invention.

Referring next to FIG. 11, this is a fragmentary schematic representation of the second layer 24 and the third layer 26 of the spout 14 showing a pattern of hot melt glue used to secure the second and third layer 24, and 26 together. Specifically, a third layer glue strip 50 (shown in two typical locations) adheres to the third glue attachment area 50*a* on the second layer 24 when folded during assembly. Additionally, and virtually simultaneously, a second layer glue strip 52 (also shown in two typical locations) adheres to a second glue attachment area 52*a* on the third layer 26 during assembly. The advantage of having two different sets of glue strips 50, and 52 between the second and third layers 24, and 26 is to provide a tighter seal between the layers. A tighter, and therefore improved, seal over previous art provides more reassurance that the box 10 is moisture-resistant and more sift-resistant.

Figure 12:
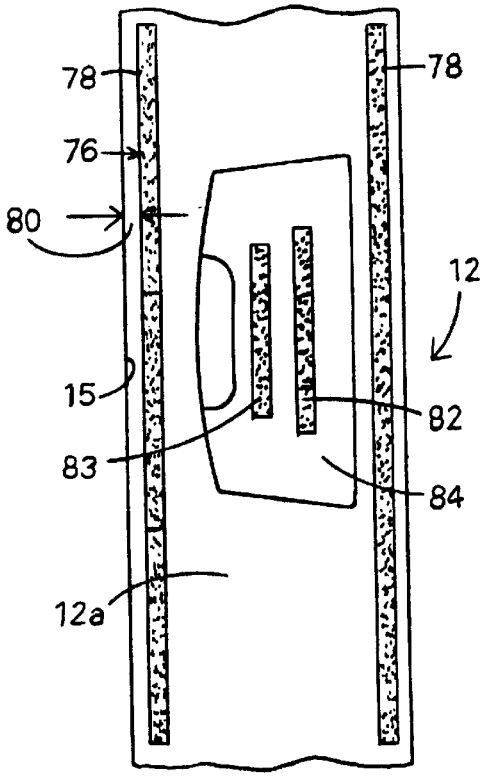
FIG. 12 is a fragmentary schematic representation of a rectangular hot melt glue pattern used on the end panel, according to the present invention.

Now referring to FIG. 12, a fragmentary schematic representation of a rectangular hot melt glue pattern 76 is shown as used on an underside 12*a* of the end panel 12. Typically, the hot melt glue pattern 76 has two or more separate glue strips 78 laid onto the underside 12*a* during the gluing application operation. During assembly, the underside 12*a* adheres to an end panel inner cover (not shown). In addition to the hot melt glue pattern 76 described, a special case of this pattern is used on each dust flap 46 as previously shown in FIG. 4. Because each dust flap 46 is virtually square, the gluing pattern will typically be a square pattern. Regardless of the pattern required, each separate glue strip 78 is laid a distance D 80 from the perimeter 15 of the end panel 12, or the appropriate perimeter of each dust flap 46. This distance D 80 is most preferably about 1/16 to 1/32 of an inch. Previous gluing arrangements in the art have used spot gluing or arbitrary application of glue. In the present invention, the gluing pattern 76 and the use of the distance D 80 provide a more secure and better sealed box 10. The advantage of having this specially designed glue pattern 76 is a tighter seal between the underside 12*a* and the end panel inner cover, and between each dust flap 46 and the top panel inner cover flap (not shown) of the top panel 16. In addition, this same glue pattern 76 is applied to the virtually identical dust flaps 46 and bottom panel inner cover flap. (The bottom panel, with its associated inner cover flap and dust flaps are not shown). Additionally, a double glue strip glue pattern 82 and 83 can be applied to the inner portion of spout 84. Therefore, the end result is an improved moisture-resistant and sift-resistant box 10.

Figure 13:
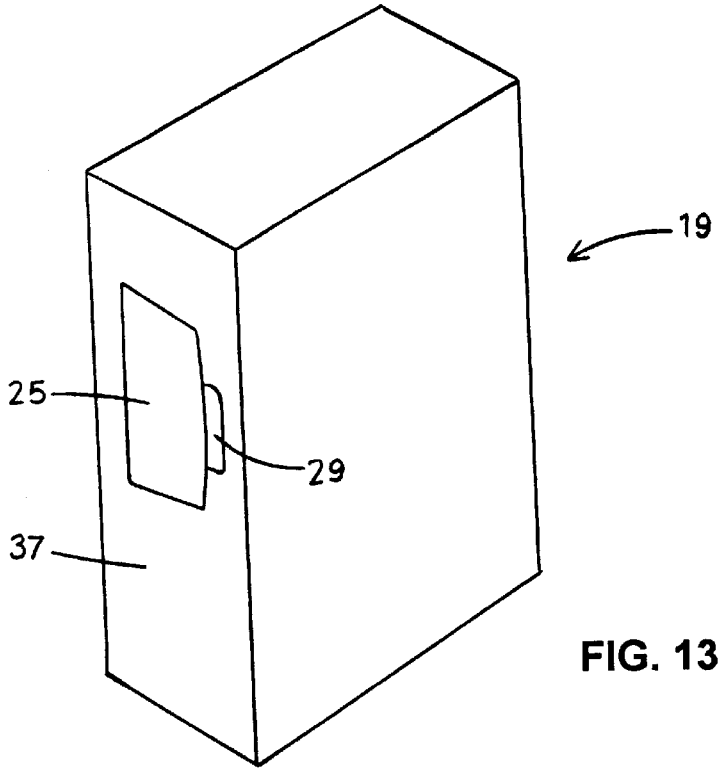
FIG. 13 is a perspective representation of the present invention illustrating a second embodiment of the present invention, with the spout having an outer finger tab.

Referring to FIG. 13, a perspective representation shows box 19 illustrating a second embodiment of the present invention, having a spout 25 on a side panel 37 of the box 19 featuring an outer finger notch 29.

Figure 14:
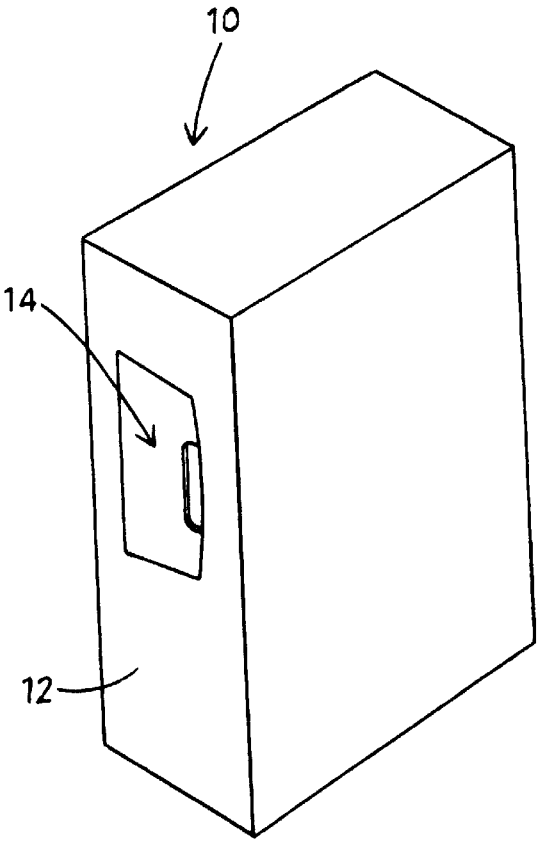
FIG. 14 is a perspective representation of the present invention illustrating a first embodiment of the present invention, with the spout in an end panel of the box.

Referring next to FIG. 14, a perspective representation of the present invention shows the first embodiment as discussed throughout this detailed description. In this preferred embodiment, the spout 14 is located in one of the end panels 12 of the box 10.

Figure 15:
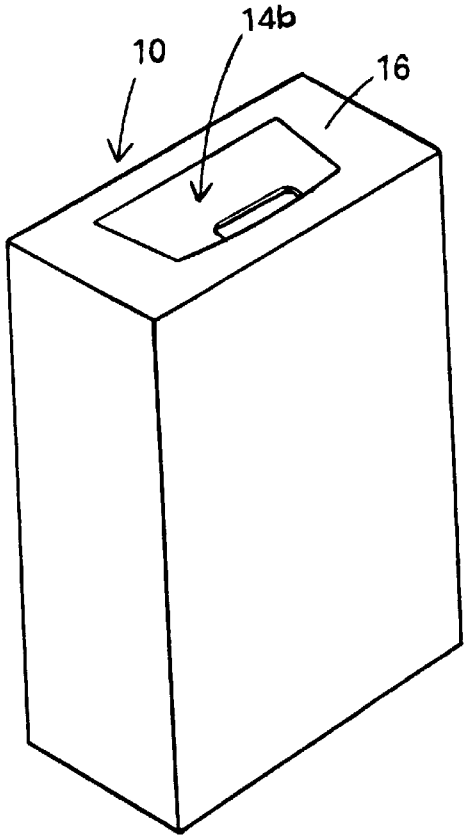
FIG. 15 is a perspective representation of the present invention illustrating a third embodiment of the present invention, with the spout on the top panel of the box.

Now referring to FIG. 15, a perspective representation shows a third embodiment of the present invention, with the spout 14*b* on the top panel 16 of the box 10.

Figure 16:
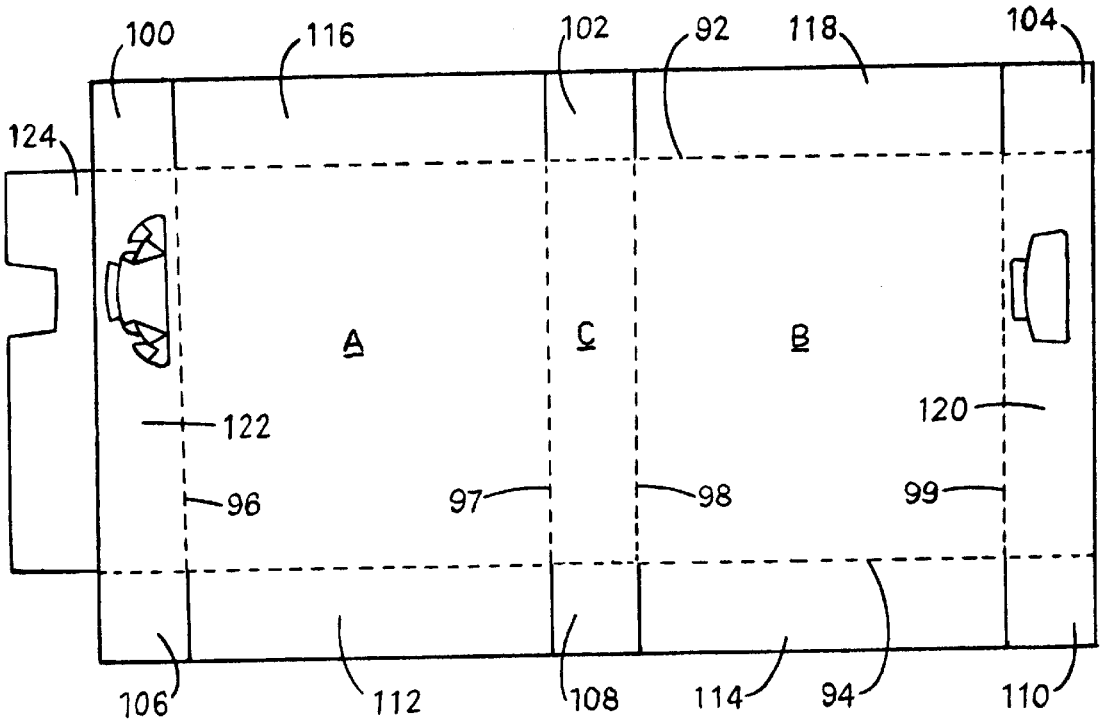
FIG. 16 is a sectional representation of the present invention illustrating the typical scoring pattern and more particularly the areas of female scoring, according to the present invention.

Now referring to FIG. 16, a sectional representation of the present invention illustrating the typical scoring pattern and more particularly the areas of female scoring, according to the present invention, box 90 is shown in a cut and scored for folding, but unfolded and flat position. There are two horizontal female scores 92 and 94, shown as broken lines, as well as four vertical scores 96, 97, 98 and 99, also shown as broken lines, which may be male or female in orientation. All of the previously mentioned scores define box panels A, B and C. Cuts in the box 90 define dust flaps 100, 102, 104, 106, 108 and 110. The scores together with the cuts define box 90 lower panels 112 and 114, box 90 upper panels 116 and 118 as well as side panels 120 and 122. Finally, outer cuts in the unfolded box 90 define inner side flap 124.

When folded during assembly, box 90 panels A and B become parallel to one another and perpendicular to panel C after being folded relative to scores 97 and 98. To complete the bottom of the box 90 dust flap 108 is folded up about female score 94, as are box panels 112 and 114 following dust flap 108. In this way, the outer edges of dust flap 108, and all other dust flaps will fit snugly and quickly into the female scores, facilitating greater moisture resistance, greater sift resistance and significantly more rapid and accurate assembly.

Figure 17:
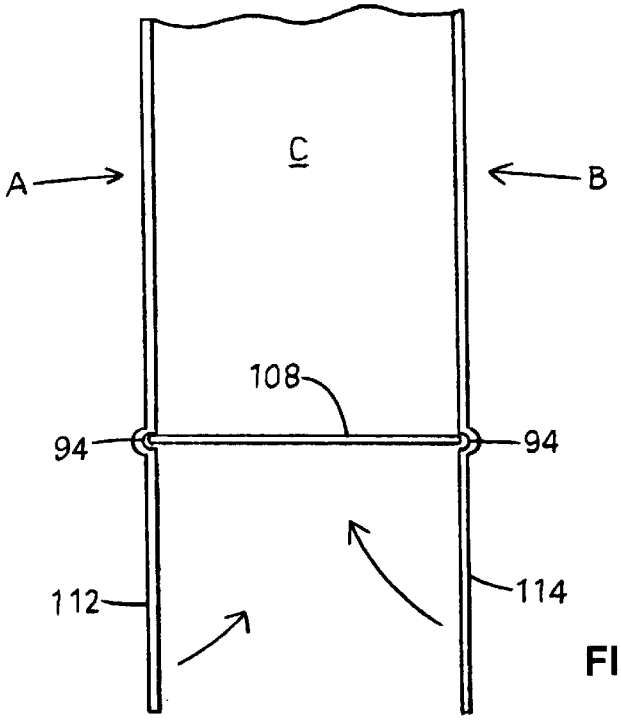
FIG. 17 is a fragmentary side elevational view illustrating how the dust flap on a typical box mates with the female scoring of a typical box panel, according to the present invention during and after folding and assembly of the typical box.

Lastly, referring to FIG. 17, a partial fragmentary side elevational view illustrating how the dust flaps on a typical box mates with the female scores of a typical box panels, according to the present invention during and after folding and assembly of the typical box. Panel A and B are now parallel to each other, and perpendicular to Panel C, after folding about scores 97 and 98. The outer edges of dust flap 108 now fit snugly into female score 94. To complete folding of the bottom of box 90, panels 112 would be folded up to make contact with dust flap 108, followed by panel 114 to make contact with panel 112. Hot glue melt patterns (not shown) on the dust flaps would act to seal the panels to the dust flaps and hot melt glue patterns (not shown) on the panels would ensure solid construction of the entire box. The improved snug fit acts to make box assembly more accurate, with flaps and panels being better aligned, and more rapid box folding and assembly is facilitated.

The present invention improves the solutions to the many problems associated previously with box design and construction. Novel improvements have been clearly described to a box for sealing the contents against moisture, and unwanted leakage of the contents. Improvements to the spout, to the gluing arrangement, and to the scoring procedure have been provided. No longer will the user have to discard purchases because of inedible or unusable contents. No longer will the manufacture of the boxes have to manage so many parts and assemblies. And no longer will the user be as frustrated with difficult to seal boxes. These unique improvements also mean that the frequent use of a waxed paper or paper-like bag can be eliminated from the manufacturing process, thereby reducing costs. At the same time, the great user frustration of opening the bag within the box is also eliminated.

Consequently, while the foregoing description has described the principle and operation of the present invention in accordance with the provisions of the patent statutes, it should be understood that the invention may be practiced otherwise as illustrated and described above and that various changes in the size, shape, and materials, as well as on the details of the illustrated construction may be made, within the scope of the appended claims without departing from the spirit and scope of the invention.

What is claimed is:

1. A box having a pouring spout comprising:

a fibrous structure defining a box, said box further comprising two side panels; a top panel; a bottom panel; and two end panels, one of said panels including a first outer layer and a second layer inwardly of said first layer, said first layer being pivotal about one edge thereof, said second layer being pivotal about one edge thereof, said second layer including means for lifting said second flap at a location spaced from one edge thereof, said second layer including two wing flaps at opposite ends of said second layer, said wing flaps including means for permitting bending of said wing flaps at scored junctures in said second layer, said wing flaps further including additional means for permitting bending of said wing flaps at perforations in locations proximately and equally spaced from said opposite ends thereof, said first flap overlying and being secured to said second flap between said one edge of said second layer and said location in said second layer, said structure including a third layer inwardly of said second layer, said third layer being secured to said second layer;

said third layer having an opening covered by said second layer, whereby to achieve an open position, said first layer is pivoted about said one edge thereof, said second layer is caused to pivot about said one edge of said second layer, said wing flaps are bent at said junctures and virtually simultaneously at said perforations, and said opening in said third layer is uncovered to permit dispensing through said opening in said third layer.

2. A box having a spout according to claim 1, wherein the spout is constructed in an extra large configuration to accommodate pouring and retention of large particle container contents.

3. A box having a spout according to claim 1, wherein said flaps act to lock the spout in the open position and act to lock the spout in the closed position to facilitate certain pouring while in the open position and preventing leaking or spilling in the closed position.

4. A box having a spout comprising:

a fibrous structure defining a container, said container further comprising two side panels; a top panel; a bottom panel; two end panels; and multiple dust flaps, said container having a flat pattern during manufacture and before assembly, said flat pattern having horizontal transverse scores and vertical transverse scores to facilitate folding, said horizontal scores being transverse female scoring formed at the juncture between each of said panels, said vertical scores being transverse male scoring formed at the juncture between each of said panels, said dust flaps mating securely into a channel of said transverse female scoring during assembly of said container, said top panel having an inner cover flap and an outer cover flap, said outer cover flap and said inner cover flap being in an overlapping relationship after said container is assembled, said inner cover flap and said outer cover flap having transverse scoring at the juncture between said inner cover flap and said outer cover flap and said side panels, said bottom panel having a first flap and a bottom panel inner cover flap, said first flap and said bottom panel inner cover flap being in an overlapping relationship after said container is assembled, said first flap and said bottom panel inner cover flap having transverse scoring at the juncture between said first and bottom panel inner cover flaps and said side panels, said first flap and said bottom panel inner cover flap of said bottom panel having transverse scoring at the juncture between said first and bottom panel inner cover flap and said side panels, said end panels having a first end and a second end, each of said ends having a transverse scoring a distance inwardly from each of said ends, said end panels bendable at said transverse scoring forming multiple dust flaps, whereby said horizontal transverse female scoring is formed in the manufacture of said container.

5. A box having a spout according to claim 4, wherein the spout is constructed in an extra large configuration to accommodate pouring and retention of large particle container contents.

6. A box having a spout according to claim 4, wherein said flaps act to lock the spout in the open position and act to lock the spout in the closed position to facilitate certain pouring while in the open position and preventing leaking or spilling in the closed position.

7. A box having a spout comprising:

a fibrous structure defining a container, said container further comprising two side panels; a top panel; a bottom panel; and two end panels, said container having a flat pattern during manufacture and before assembly, said flat pattern having an outside part and an inside part, said outside part having transverse female scoring formed at the juncture between each of said panels, said inside part having a transverse male score formed at the juncture between each of said panels, said transverse male scoring mating securely into a channel of said transverse female scoring during assembly of said container, said top panel having an inner cover flap and an outer cover flap, said outer cover flap and said inner cover flap being in an overlapping relationship after said container is assembled, said inner cover flap and said outer cover flap having transverse scoring at the juncture between said inner cover flap and said outer cover flap and said side panels, said bottom panel having a first flap and a bottom panel inner cover flap, said first flap and said bottom panel inner cover flap being in an overlapping relationship after said container is assembled, said first flap and said bottom panel inner cover flap having transverse scoring at the juncture between said first and bottom panel inner cover flaps and said side panels, said first flap and said bottom panel inner cover flap of said bottom panel having transverse scoring at the juncture between said first and bottom panel inner cover flap and said side panels, said end panels having a first end and a second end, each of said ends having a transverse scoring a distance inwardly from each of said ends, said end panels bendable at said transverse scoring forming multiple dust flaps, whereby said transverse female scoring and said transverse male scoring are formed in the manufacture of said container, said inner cover flap of said top panel having hot melt glue applied in a generally rectangular pattern proximate to the perimeter of said inner cover flap, said bottom panel inner cover flap of said bottom panel having hot melt glue applied in a generally rectangular pattern proximate to the perimeter of said bottom panel inner cover flap, said dust flaps having hot melt glue applied in a generally square pattern proximate to the perimeter of each of said dust flaps.

8. A box having a spout according to claim 7, wherein the spout is constructed in an extra large configuration to accommodate pouring and retention of large particle container contents.

9. A box having a spout according to claim 7, wherein said flaps act to lock the spout in the open position and act to lock the spout in the closed position to facilitate certain pouring while in the open position and preventing leaking or spilling in the closed position.

10. A box having a pouring spout comprising:

a fibrous structure defining a container, said container further comprising two side panels; a top panel; a bottom panel; and two end panels, one of said panels including a first outer layer and a second layer inwardly of said first layer, said first layer being pivotal about one edge thereof, said first layer including a portion overlying a portion of said second flap, said second layer being pivotal about one edge thereof, said second layer including means for lifting said second flap at a location spaced from one edge thereof, said second layer including two wing flaps at opposite ends of said second layer, said wing flaps including means for permitting bending of said wing flaps at scored junctures in said second layer, said wing flaps further including additional means for permitting bending of said wing flaps at perforations in locations proximately and equally spaced from said opposite ends thereof, said first flap overlying and being secured to said second flap between said one edge of said second flap and said location in said second layer, said structure including a third layer inwardly of said second layer, said third layer having an opening covered by said second flap, whereby to achieve an open position, said first layer is pivoted about said one edge thereof, said second layer is caused to pivot about said one edge of said second layer, said wing flaps are bent at said junctures and virtually simultaneously at said perforations, and said opening in said third layer is uncovered to permit dispensing through said opening in said third layer, said container having a flat pattern during manufacture and before assembly, said flat pattern having an outside part and an inside part, said outside part having transverse female scoring formed at the juncture between each of said panels, said inside part having a transverse male score formed at the juncture between each of said panels, said transverse male scoring mating securely into a channel of said transverse female scoring during assembly of said container, said top panel having an inner cover flap and an outer cover flap, said outer cover flap and said inner cover flap being in an overlapping relationship after said container is assembled, said inner cover flap and said outer cover flap having transverse scoring at the juncture between said inner cover flap and said outer cover flap and said side panels, said bottom panel having a first flap and a bottom panel inner cover flap, said first flap and said bottom panel inner cover flap being in an overlapping relationship after said container is assembled, said first flap and said bottom panel inner cover flap having transverse scoring at the juncture between said first and bottom panel inner cover flaps and said side panels, said first flap and said bottom panel inner cover flap of said bottom panel having transverse scoring at the juncture between said first and bottom panel inner cover flap and said side panels, said end panels having a first end and a second end, each of said ends having a transverse scoring a distance inwardly from each of said ends, said end panels bendable at said transverse scoring forming multiple dust flaps, whereby said transverse female scoring and said transverse male scoring are formed in the manufacture of said container, said inner cover flap of said top panel side having hot melt glue applied in a generally rectangular pattern proximate to the perimeter of said inner cover flap, said bottom panel inner cover flap of said bottom panel having hot melt glue applied in a generally rectangular pattern proximate to the perimeter of said bottom panel inner cover flap, said dust flaps each having hot melt glue applied in a generally square pattern proximate to the perimeter of each of said dust flaps.

11. A box having a spout according to claim 10, wherein the spout is constructed in an extra large configuration to accommodate pouring and retention of large particle container contents.

12. A box having a spout according to claim 10, wherein said flaps act to lock the spout in the open position and act to lock the spout in the closed position to facilitate certain pouring while in the open position and preventing leaking or spilling in the closed position.

* * * * *